United States Patent [19]

Karl et al.

[11] Patent Number: 4,463,548

[45] Date of Patent: Aug. 7, 1984

[54] PIVOTABLE SUCTION TUBE FOR TAKING UP A YARN FROM A BOBBIN

[75] Inventors: Rupert Karl; Walter Mayer, both of Ingolstadt, Fed. Rep. of Germany

[73] Assignee: Schubert & Salzer Maschinenfabrik Aktiengesellschaft, Indolstadt, Fed. Rep. of Germany

[21] Appl. No.: 384,249

[22] Filed: Jun. 2, 1982

[30] Foreign Application Priority Data

Jun. 12, 1981 [DE] Fed. Rep. of Germany ..... 3123282

[51] Int. Cl.[3] ..... D01H 15/02; B65H 54/22

[52] U.S. Cl. ..... 57/263; 57/305; 242/35.6 R; 242/35.6 E

[58] Field of Search ..... 57/263, 261, 305, 262; 242/35.6 R, 35.6 E, 35.5 A

[56] References Cited

U.S. PATENT DOCUMENTS

| | | | |
|---|---|---|---|
| 2,432,722 | 12/1947 | Campbell | 242/35.6 R |
| 3,077,312 | 2/1963 | Furst | 242/35.6 R |
| 3,131,879 | 5/1964 | Glastra et al. | 242/35.6 R |
| 3,136,494 | 6/1964 | Furst | 242/35.6 R |
| 3,595,493 | 7/1971 | Tsukuma et al. | 242/35.6 R |
| 3,810,352 | 5/1974 | Miyazaki et al. | 57/263 |
| 4,120,140 | 10/1978 | Raasch et al. | 57/263 |
| 4,145,867 | 3/1979 | Kamp | 57/263 |

*Primary Examiner*—John Petrakes
*Attorney, Agent, or Firm*—Julian W. Dority

[57] ABSTRACT

In a pivotable suction tube (3) for taking up a yarn from a bobbin, there is provided for transfer of the yarn to an operating element, on its side facing the bobbin, an elongate slot (32), with which is associated a controllable closure piece (33, 35) extending over at least a substantial portion of it. The suction tube (3) possesses a tubular section (30) having a shape being symmetric to its axis with which is associated as a closure piece a rotatable slider (33) provided with an axial slot (330). The closure piece (33, 35) carries a stop (333, 352) with which is associated a counter-stop (20, 410) which becomes effective in dependence on the pivoting motion of the suction tube (3).

8 Claims, 4 Drawing Figures

PIVOTABLE SUCTION TUBE FOR TAKING UP A YARN FROM A BOBBIN

BACKGROUND OF THE INVENTION

The present invention relates to a pivotable suction tube for taking up a yarn from a bobbin and transferring the yarn to an operating element. The pivotal suction tube has a longitudinally extending slot on its side towards the bobbin.

For automatic start-up, it is known to provide on open-end spinning machines, for automatic take-up of the yarn from a bobbin, a suction tube which can be pivoted into the immediate neighborhood of the bobbin. The suction tube has an elongated slot on its side towards the bobbin so that a section of the yarn sucked into the suction tube leaves again through the elongate slot in the manner of a chord, so that it is accessible to operating elements which take part in the start-up and can be grasped by them (DE-OS No. 2,008,142). However, this slot has the disadvantage that a very large reduced pressure must be produced because of the great loss of reduced pressure through the slot, so that the yarn is taken up with certainty from the bobbin and sucked into the suction tube. A powerful source of reduced pressure with high power usage is thus required.

To avoid this disadvantage, it is already known to construct a suction tube without a slot (DE-OS No. 2,620,805). In order, nevertheless, to make the yarn accessible here and to be able to transfer it to an operating element, the suction tube requires a large pivoting path. In spite of this, however, it is not possible, with pivoting paths realizable in practice, to feed the yarn in this pivoting motion to an operating element, since the distance from the mouth of the suction tube to the operating element located in the vicinity of the spinning element is very large. Therefore, a gripper is required which grips the yarn and feeds it to the operating element while maintaining the yarn tension. Because of the large pivoting regions of the suction tube and also of the gripper, the prior art apparatus is extremely expensive. In addition to this, a relatively large lapse of time is necessary because of the additional pivoting path of the suction nozzle and also because of the gripping of the yarn and its feeding to the operating element.

SUMMARY OF THE INVENTION

The object of the present invention is to provide a suction tube for taking up a yarn from a bobbin and transferring the yarn to an operating element while operating economically with a small lapse of time and small air and space requirement.

This problem is solved by the invention in that there is associated with the elongate slot on the side of the suction tube towards the bobbin a controllable closure piece which, in its closed position, covers substantially the whole length of the elongated slot. By means of such a closure piece, the elongate slot in the suction tube can remain closed during the takeup and sucking away of the yarn from the bobbin, so that the air requirement is small. When the suction tube has sucked a sufficiently long length of yarn from the bobbin, the closure piece is removed from the elongate slot, so that the yarn is released. Because of the yarn tension produced by the reduced pressure, the yarn section located in the region of the elongate slot now leaves the suction tube and assumes the shortest path between the bobbin and the end of the slot. The yarn then arrives in the region of an operating element, since the elongate slot in the suction tube already takes over the essential part of the feeding of the yarn into the working region.

In principle, the closure piece can be constructed in any suitable manner. In order to ensure that the closure piece is never located in the yarn path, which is defined by the end of the slot and also the point at which the yarn reaches the bobbin, according to a further feature of the invention, the closure piece is constructed as a slider movable transversely of the elongate slot. Here the suction tube advantageously possesses a tubular section with a shape which is symmetric in respect to the axis of this tubular section, with which is associated a rotary slider provided with an axial slot, this tubular section being preferably surrounded by the rotary slider for better control accessibility.

In order to be able to maintain large tolerances, with certain function, for the positioning paths of the closure piece constructed as a rotary slider, according to a further feature of the invention, the axial slot in the rotary slider is wider than the elongate slot in the tubular section.

So that clamping of the yarn on displacement of the closure piece contructed as a slider is avoided with certainty, the end of the closure piece towards the bobbin is appropriately mounted in a groove of the suction tube. In this manner, the yarn in the non-displaceable part of the suction tube is conducted on both sides of the closure piece and thus prevented from following the motion of the closure piece, and it is thereby then ensured that the yarn is not taken in between the nondisplaceable suction tube and the closure piece.

The closure piece can be driven in various ways, for example, by a single drive action in two direction. Advantageously, however, the closure piece is acted on by an elastic element, e.g. a spring, which holds it when released by its actuating drive in its closed position defined by a stop. In this manner, a very simple drive can be applied to displace the closure piece. Preferably it is provided as a drive that the closure piece carries a stop with which is associated a counter-stop that becomes effective in dependence on the pivoting motion of the suction tube.

Because the elongate slot in the suction tube is closed during the takeup of the yarn at the bobbin and during pulling away of the yarn, no loss of reduced pressure occurs during this phase and the reduced pressure acts fully on the yarn. Hereby a considerably smaller requirement for reduced pressure exists in comparison with the prior art slotted suction tubes so that the reduced pressure source can be smaller, substantially increasing the economy of operation of this suction tube. Since the yarn can partially emerge from the suction tube through the now released slot and then arrives in the immediate vicinity of an operating element, neither a large pivoting path of the suction tube nor an additional feeding element are necessary, to forward the yarn over a further path, from the yarn path between the opening of the suction tube and the bobbin, as far as the operating element. Thus, a large saving of space and time is achieved by the apparatus according to the invention, by the omission of additional pivoting paths, as compared with suction tubes closed at the periphery.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The object of the invention explained below with reference to FIG. 1 can, in principle, be provided at each individual spinning position of an open-end spinning machine 1. However, a start-up apparatus 2 which can travel along the machine is more usually associated with the open-end spinning machine 1, in order to be able to carry out the start-up of the yarn at a number of spinning positions with certainty and thus obtain yarn piecings of uniform quality.

Figure 1:
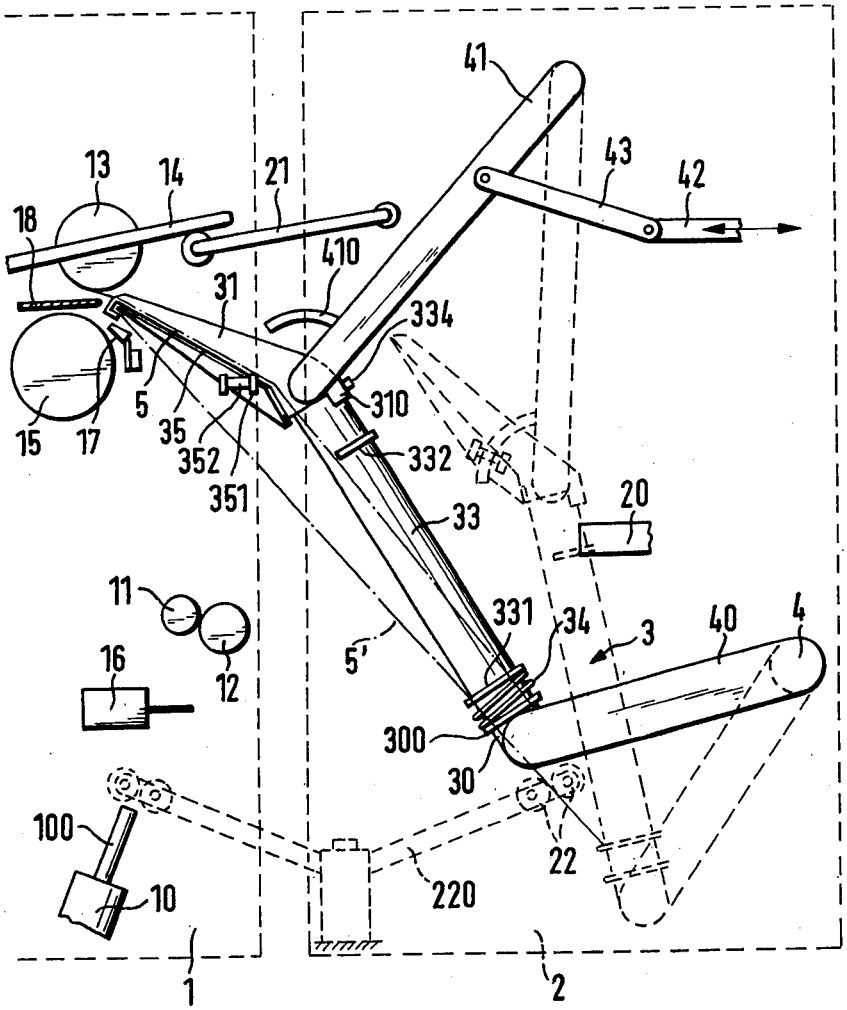
FIG. 1 is a side view of an open-end spinning position with the suction tube constructed according to the invention positioned in a yarn takeup position of the suction tube shown by full lines, and its initial position indicated by dash lines.

A spinning position is shown in FIG. 1 with only its parts which are essential for an understanding of the invention. Each of these spinning positions possesses a spinning apparatus 10 from which the yarn 5 produced there is drawn off through a takeoff tube 100 by means of takeoff rolls 11 and 12. The yarn 5 is wound up on a bobbin 13 during normal spinning operation by means of a yarn traverse guide 17. The bobbin is rotatably carried between two bobbin arms 14 and is driven by abutment on a drive shaft 15.

If a yarn break occurs, a yarn monitor 16 located in the yarn path registers the drop in yarn tension and effects the stopping of fiber feed into the spinning apparatus 10. Simultaneously, a bobbin support element 18 is pushed between the drive shaft 15 and the bobbin 13 so that the bobbin 13 is brought to rest.

The start-up apparatus 2 has, besides other elements which are not illustrated here, a pivotable suction tube 3, the end of which towards the bobbin 13 is constructed in gap form and extends over the whole width of the bobbin 13. This gap-like cross section of the yarn takeup part 31 merges into a round cross section which extends over the main part 30 of the suction tube 3. According to the construction of the suction tube 3, the end remote from the bobbin 13 of this tubular section forming the main part 30 is joined, either directly or via an articulated intermediate piece 40, to a suction pipe 4 which is stationary with respect to the start-up apparatus 2 and which, in turn, is connected to a source of reduced pressure (not shown). Associated with the suction tube 3 is a pivoting drive which has a pivoting lever 41 holding the suction tube 3 and also a drive rod 42. These are connected together by a coupling element 43.

Figure 2:
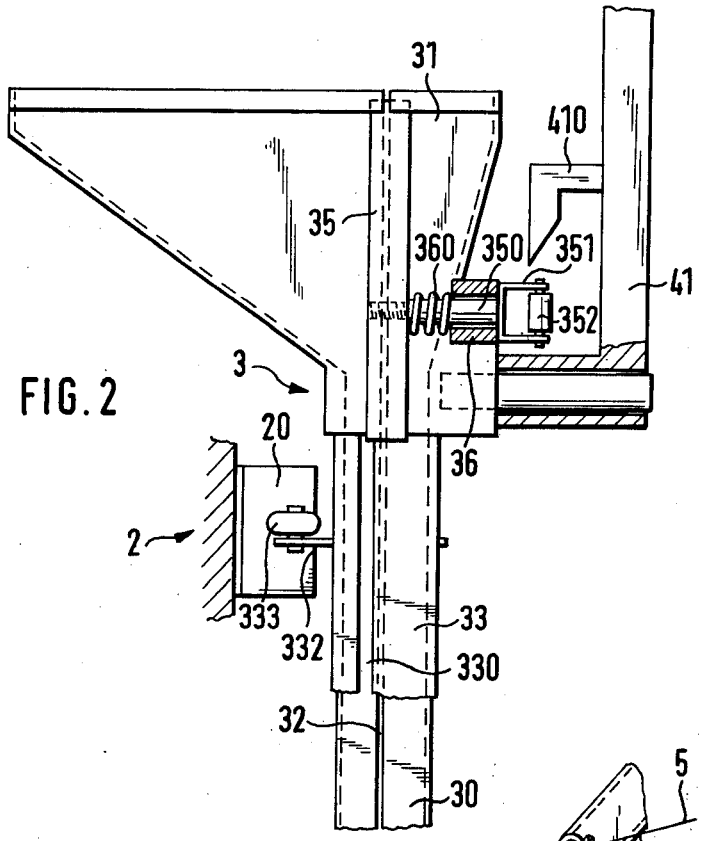
FIG. 2 is a view of the side of the suction tube shown in FIG. 1 which has a slot, and also the control elements for the closure pieces associated with the slot.

As can be seen from FIG. 2, the yarn takeup part 31 is arranged at an angle to the cylindrical main part 30. The main part 30 and the yarn takeup part 31 are non-rotatably connected together. The yarn uptake part 31 and the main part 30 have a through elongate slot 32. The main part 30 is surrounded by a sleeve forming a rotary slider 33 which has an axial slot 330 over its whole length. The rotary slider 33 has at its end remote from the bobbin 13 a flange 331 in which is anchored one end of a torsion spring 34. The other end of the torsion spring is anchored in a flange 300 carried by the main part 30 of the suction tube 3.

The rotary slider 33 carries a stop 333 constructed as a roller on a radial boom 332 and associated with which is a stationary stop 20 in the start-up apparatus 2. This arrangement is such that the stop 333, in the last part of its motion from the yarn takeup position shown in FIG. 1 by full lines into its initial position shown by dashed lines, runs against the stop 20 and rotates the rotary slider 33 against the action of the torsion spring 34 into the position shown in FIG. 2, in which the axial slot 330 releases the elongate slot 32. The rotary slider 33 has, at its end towards the yarn takeup part 31 of the suction tube 3, a radially projecting stop 334 with which is associated a stop 310 on the yarn takeup part 31. As long as the stop 333 is released by the stationary stop 20, the stop 334, due to the action of the torsion spring 34, abuts the stop 310, so that these two stops 334 and 310 hold the rotary slider 33 in a closed position such that the stop 333, on pivoting motion of the suction tube 3, can run with certainty against the stop 20.

The yarn takeup part 31 does not have a cylindrical shape, since it possesses an opening extending over the whole width of the bobbin so no rotary slider can be used as closure piece as with the main part 30. The yarn takeup part 31, therefore, possesses a guide surface in the region around the elongate slot 32 and along which a slider 35 can be pushed transversely of the course of the elongate slot 32. The slider 32 is guided in a mounting 36 carried by the suction tube (FIG. 2). To the mounting 36 is also joined the pivoting lever 41. The slider 35 is acted on in the closing direction by a compression spring 360 supported on the mounting 36. A fork 351 acting as a stop, and carrying a stop 352 constructed as a roller, is connected to the slider 35 via a guide bolt 350. The pivoting lever 41 carries a stop 410 constructed as a control wedge and arranged on the pivoting lever 41 such that the stop 410, in the last part of the motion of the suction tube 3 out of its yarn takeup position into the initial position, engages on the side towards the slider 35 of the stop 352 and displaces this, and thus also the slider 35, to an extent such that the elongate slot 32 is released.

In order to be able to explain the function of the invention in connection with the course of work during start-up of spinning, of course, reduced to the more essential steps, still further means of the start-up apparatus 2 are described below. This start-up apparatus has, among other things, a bobbin lifter arm 21 which is pivotably mounted and can be brought to abut on the bobbin arm 14.

The start-up apparatus further has a feeder roll pair 22 which is pivotably mounted by means of a pivot arm 220 such that when it pivots, it can grip the yarn 5 which has emerged from the suction tube 3 and bring it exactly above the takeoff tube 100.

The invention operates as follows:

When a yarn break occurs which can arise both on stopping the machine or because of a yarn fault, the end of the yarn 5 reaches the bobbin 13. The yarn monitor 16, on the resulting fall in yarn tension, causes fiber feed into the spinning element to be stopped and the bobbin support element 18 lifts the bobbin 13 from its drive shaft 15.

The start-up apparatus 2 is now conventionally called to the spinning position which has the drop in yarn tension where it lifts the bobbin 13, by means of the pivotable bobbin lifter arm 21 from the bobbin support element 18. Simultaneously, the suction tube 3 is pivoted towards the bobbin 13 as far as its immediate vicinity. At the same time, the stops 333 and 352 are released by the stops 20 and 410 so that the slider 35 and also the rotary slider 33, acted on by the springs 34 and 360, close the elongate slot 32 of the suction tube 3. The stop 334 and the fork 351 arrive at the same time in abutment on the stop 310 or the mounting 36, respectively. The suction tube 3 is simultaneously connected to a reduced pressure source while the bobbin 13 is drive in a manner not shown in the unwinding direction. The suction air stream acting in the yarn takeup part 31 of the suction tube 3 then seizes the yarn end and pulls the yarn 5, which becomes free due to the bobbin 13 being turned back, into the suction tube 3. Since the elongate slot 32 of the suction tube 3 is closed, no reduced pressure is lost, so that the whole of the reduced pressure applied to the suction tube 3 is effective at the opening of its yarn takeup part 31. When a sufficient length of yarn has been pulled off—which is conventionally controlled, for example, by the number of revolutions of the bobbin 13 or of its drive in the unwinding direction—the suction tube 3 is pivoted back out of its yarn takeup position, shown in FIG. 1 by full lines, into its initial position (shown dashed). At the same time, the stop 333 runs against the stop 20, which is stationary with respect to the start-up apparatus 2, while the stop 352 runs against the stop 410 constructed as a control wedge and carried by the pivoting lever 41. If desired, this can also occur in a successively timed manner. By this contact of the stops 333 and 352, the elongate slot 32 is released by the slider 35 and the rotary slider 33, which together form a divided closure piece. The yarn hereby emerges from the elongate slot 32 in the endeavor to assume the shortest path between bobbin 13 and the end of the elongate slot 32 remote from the bobbin 13, while the free yarn end extends as far into the suction pipe 4 and is thus securely held in the suction tube 3. The yarn section located outside the suction tube 3 now assumes the position 5', in which it is located in the pivoting region of the feed roll pair 22 which by pivoting grips the yarn 5 and, after parting by means of a parting device (not shown) feeds it to the takeoff tube 100 of the start-up apparatus 10. Premature contact with the takeoff rolls 11, 12 is prevented by a conventional yarn guide element (not shown). The separated yarn end is carried away by the reduced pressure acting in the suction tube 3. By driving the feeder roll pair 22 located above the takeoff tube 100 and also the bobbin 13 in the unwinding direction, the yarn 5 is supplied back as far as the collecting surface of the spinning element (not shown) forming one part of the spinning apparatus 10, upon which the yarn 5 is released by spreading and pivoting back of the feeder roll pair 22. Simultaneously, fiber feed into the spinning element is released in a known manner, and the bobbin is lowered onto the bobbin support element 18 by lowering the bobbin lifter arm. The bobbin support element 18 is now pulled back so that the bobbin 13 is again driven in the windup direction and the yarn 5 again reaches the working region of the yarn traverse guide 13 and because of the yarn tension again produced comes into the nip line of the takeoff rolls 11, 12. The suction air in the suction tube 3 is now also shut off. The start-up process is thus concluded.

The closure piece can, as shown by the above description, be variously constructed. Its shape depends largely on the shape of the suction tube 3. Thus, for example, a single closure piece can be provided which extends over the whole length of the elongate slot 32. The closure piece can then be arranged at the end of a pivoting lever and can be able to be brought to abut against the suction tube 3 or lifted away from it by pivoting away. However, the closure piece can also be constructed as a slider which is displaceable along, or transverse of, the elongate slot 32. With a transverse motion of the slider, a relatively short adjusting path is sufficient, for which reason this direction of adjustment of the slider is particularly appropriate.

When the yarn takeup part 31 of the suction tube 3 is not very large, under some circumstances, a closure piece for this yarn takeup part 31 can even be omitted so that a single slider, preferably a rotary slider, is sufficient for the main part 30 of the suction tube 3. Here it is not even required that this main part 30 has a cylindrical shape; other axially symmetrical shapes, e.g. conical with small conicity, or composite bodies with circular cross sections, are likewise possible. With this axially symmetrical form, the closure piece can be constructed as a rotary slider 33 with an axial slot 330, which presents advantages with respect to production, mounting, and guiding on the suction tube 3.

With the construction shown for the object of of the invention, the rotary slider 33 is constructed as a sleeve surrounding the main part 30 of the suction tube 3, since it is then particularly simple to actuate the rotary slider 33. However, it is possible in principle to arrange the rotary slider 33 inside the suction tube 3 and to provide actuating elements on the rotary slider 33 which project out through peripheral slots in the suction tube 3, so that the rotary slider can be actuated in the manner described.

The control of the closure piece (slider 35 and/or rotary slider 33) can be effected in a different manner by a stationary stop 20 or by a stop 410 arranged on the rod of the suction tube 3 and becoming effective due to the pivoting motion of the suction tube 3; however, it is also possible to provide other drives for the displacement of the closure piece. These can then act in both directions on the closure piece, e.g., in the form of an electromagnet or a hydraulic or pneumatic piston. However, it is also possible that the drive controls only one motion and that the closure piece (slider 33, rotary slider 35) is acted on by a spring (34, 360) or another elastic element which holds the closure piece in abutment on a stop (310 or fork 351) on release by its drive (e.g. stops 20 and 410). This position then corresponds to the closed position of the closure piece. This elastic element can then be fitted in any manner between the suction tube 3 and the slider 35 or the rotary slider 33, e.g. as a compression spring or tension spring between boom arms, or as a torsion spring, etc.

In order not to have to limit the stroke path by stops, elastic transmission elements, etc. when the closure piece is displaced, it is provided according to FIG. 2 that the axial slot 330 in the rotary slider 33 is wider than the elongate slot 32 in the suction tube 3. In an embdiment of this kind, just as with a rectilinearly movable slider 35, no special conditions are placed on the tolerances since it must only be ensured that in the one position of the closure piece, the elongate slot 32 is closed, while this must be released in the other position of the closure piece.

Figure 3:
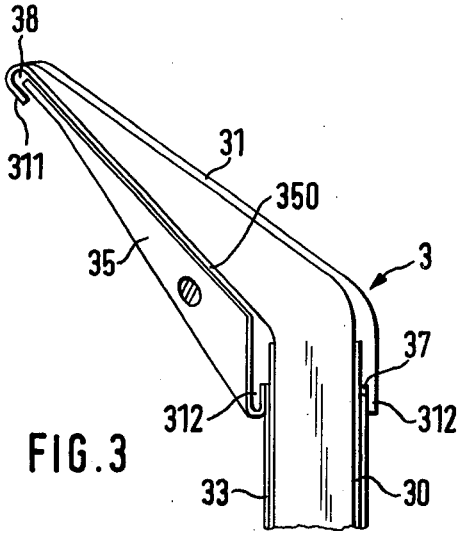
FIG. 3 is a cross section through the suction tube in the region of the end of the closure piece located adjacent the bobbin.
Figure 4:
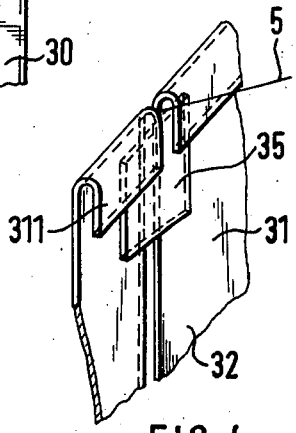
FIG. 4 is a perspective view of the opening of the yarn takeup part of the suction tube and also a part of the closure piece.

Since the yarn 5 lies during motion of the closure piece on its edge facing the bobbin 13, there exists the danger that the yarn 5 is carried along during the abutment motion of the closure piece and is then clamped in the slot between the closure piece (slider 35 or rotary slider 33) and the suction tube 3 (yarn takeup part 31 or main part 30). In order to prevent this with certainty, it is provided according to FIGS. 3 and 4 that the closure piece is mounted in a groove 37 or 38. For the slider 35, this groove is formed by turning over the mouth of the yarn takeup part 31, so that the slider 35 is guided between the yarn takeup part 31 itself and the turned-over edge 311. For the rotary slider 33, this groove 37 is formed between the main part, connected non-rotatably to the yarn takeup part 31, of the suction tube 3 and an annular projection 312 of the yarn takeup part 31. Of course, both the turned-over part 311 and also the annular projection 312 are likewise slotted in correspondence with the elongate slot 32 of the suction tube 3.

When the yarn 5 lies on the end of the closure piece (slider 35 or rotary slider 33) facing the bobbin 13, the yarn 5 is guided on both sides of the closure piece by the yarn takeup part 31 and also its turned-over part 311 or the main part 30 of the suction tube 3 and the projection 312 of the yarn takeup part. Thus, if the closure piece is moved relative to the suction tube 3, the yarn is prevented by this guiding on both sides by the closure piece from following the motion of the closure piece, whence also a clamping of the yarn 5 between the closure piece and the suction tube 3 is prevented. Since, when the yarn 5 located in the position 5' is taken over by the feeder roll pair 22, the yarn 5 is parted and the separated yarn end is carried away, the yarn 5 also cannot be clamped in by the closure piece on closing of the elongate slot 32.

Besides the stated advantages of the space, reduced pressure, and time savings, the object of the invention further offers the advantage that the yarn 5 cannot be released at an undesired moment and drawn out of the suction tube 3 by external influences, or otherwise be impaired, since only when it is to be taken over by another operating element is it conducted to the working region of this operating element by release of the elongate slot 32.

Further modifications of the object of the invention by mutual interchange of the elements or by substitution of equivalents, and also their combination, fall within the scope of the present invention.

What is claimed is:

1. A pivotable suction tube for taking-up a yarn from a bobbin and transferring the yarn to an operating element, said pivotable suction tube being of the type having a longitudinally extending slot provided in a front side of said suction tube facing the bobbin, said suction tube comprising:

a controllable closure piece carried by said suction tube associated with said elongated slot;

said closure piece having a closed position in which said closure piece substantially covers the whole length of said elongated slot and an open position in which said closure piece uncovers the whole length of said elongated slot; and means for acting on said closure piece to move and hold said closure piece in said open and closed positions in response to said suction tube pivoting, respectively, from an initial position to a yarn takeup position wherein said suction tube is positioned adjacent said bobbin.

2. The suction tube according to claim 1, wherein said closure piece includes a slider movable transversely to said elongated slot.

3. The suction tube according to claim 2, wherein said suction tube includes a tubular section which is symmetrical about its axis, and a rotary slider being carried about said symmetrical tubular section which rotates about said tubular section, said rotary slider including an axial slot which aligns with said elongated slot when in said open position.

4. The suction tube according to claim 3, wherein said rotary slider has a circular cross section and surrounds said tubular section of said suction tube.

5. The suction tube according to claim 3 or 4 wherein said axial slot in said rotary slider is wider than the elongated slot in said tubular section.

6. The suction tube according to claim 2 wherein said closure piece includes an end piece carried adjacent a free end of said suction tube adjacent said bobbin, and a groove formed in said suction tube adjacent said free end in which said closure piece is mounted.

7. The suction tube according to claim 1 further including:

an elastic element carried by said suction tube, said elastic element acting on said closure piece to hold said closure piece in said closed position, and a stop for acting on said elastic element.

8. The suction tube according to claim 1 including:

means for moving said suction tube in a pivoting motion;

a stop carried by said closure piece; and a counter stop associated with said stop for limiting the pivoting motion of said suction tube.

* * * * *